US011807426B2

(12) United States Patent
Fengke

(10) Patent No.: US 11,807,426 B2
(45) Date of Patent: Nov. 7, 2023

(54) 360 DEGREE LID

(71) Applicant: Scribe OpCo, Inc., Clearwater, FL (US)

(72) Inventor: Tian Fengke, Zhejiang (CN)

(73) Assignee: SCRIBE OPCO, INC., Clearwater, FL (US)

( * ) Notice: Subject to any disclaimer, the term of this patent is extended or adjusted under 35 U.S.C. 154(b) by 0 days.

(21) Appl. No.: 17/030,473

(22) Filed: Sep. 24, 2020

(65) Prior Publication Data

US 2021/0086959 A1 Mar. 25, 2021

Related U.S. Application Data

(60) Provisional application No. 62/904,818, filed on Sep. 24, 2019.

(51) Int. Cl.
*B65D 47/06* (2006.01)

(52) U.S. Cl.
CPC ..... *B65D 47/061* (2013.01); *B65D 2251/205* (2013.01); *B65D 2547/066* (2013.01)

(58) Field of Classification Search
CPC ..... B65D 2251/1033; B65D 2251/205; B65D 2251/1066; B65D 47/061; B65D 25/44; B65D 247/066; B65D 2547/066; Y10T 137/87949; Y10T 137/86331; Y10T 137/8704; Y10T 137/87917
USPC ..... 222/484, 511, 518, 522
See application file for complete search history.

(56) References Cited

U.S. PATENT DOCUMENTS 2,828,893 A * 4/1958 Stewart ..... B65D 47/242 222/453
2,963,205 A * 12/1960 Beall, Jr. ..... B65D 47/248 222/484
4,564,132 A * 1/1986 Lloyd-Davies ..... B65D 77/067 137/614.04
4,886,193 A * 12/1989 Wassilieff ..... B65D 47/242 222/446
4,930,689 A * 6/1990 Stumpf ..... B67D 3/043 137/588
4,960,218 A * 10/1990 Toida ..... A47J 41/0027 215/311
5,392,967 A * 2/1995 Satomi ..... B65D 47/248 222/509
5,435,470 A * 7/1995 Kim ..... A47J 41/0027 222/509
5,495,966 A * 3/1996 Won ..... A47J 41/0027 222/545

(Continued)

*Primary Examiner* — Charles P. Cheyney
(74) *Attorney, Agent, or Firm* — Shumaker, Loop & Kendrick, LLP; James D. Miller

(57) ABSTRACT

A lid assembly includes an internal component assembly having a first end, a second end opposite the first end, and a button disposed at the first end. An external component receives the internal component assembly. The external component is configured for engaging a container. The internal component assembly cooperates with the external component to translate axially upon a first pressure to the button to permit a fluid to enter the external component adjacent the second end of the internal component assembly and to militate against the fluid to enter the external component adjacent the second end of the internal component upon a second pressure to the button.

6 Claims, 3 Drawing Sheets

(56) References Cited

U.S. PATENT DOCUMENTS

| | | | | |
|---|---|---|---|---|
| 6,299,037 | B1 * | 10/2001 | Lee | B65D 47/248 222/518 |
| 6,662,978 | B2 * | 12/2003 | Lin | B65D 47/248 222/509 |
| 7,073,678 | B1 * | 7/2006 | Dibdin | A47G 19/2272 222/548 |
| 8,272,532 | B2 * | 9/2012 | Michaelian | A47G 19/2272 220/203.23 |
| 8,348,078 | B2 * | 1/2013 | Lane | A47G 19/2272 220/203.07 |
| 8,511,639 | B2 * | 8/2013 | Johnson | B67D 1/0829 251/149.6 |
| 8,967,414 | B2 | 3/2015 | Lane | |
| 2002/0170874 | A1 * | 11/2002 | Hou | A47G 19/2266 215/229 |
| 2004/0040962 | A1 * | 3/2004 | Bielecki | A47J 41/0022 220/254.1 |
| 2010/0237078 | A1 | 9/2010 | Lentz et al. | |
| 2014/0042188 | A1 * | 2/2014 | Greiner-Perth | B05B 11/3005 222/153.13 |
| 2015/0217909 | A1 * | 8/2015 | Garcia Cortes | B65D 47/127 222/511 |
| 2016/0296050 | A1 | 10/2016 | Lane | |
| 2018/0208369 | A1 * | 7/2018 | Rigel | B65D 25/44 |

* cited by examiner

360 DEGREE LID

CROSS REFERENCE TO RELATED APPLICATIONS

This application claims the benefit of U.S. Provisional Application No. 62/904,818, filed on Sep. 24, 2019. The entire disclosure of the above patent application is hereby incorporated herein by reference.

FIELD

The present invention relates generally to lids, and more particularly to a 360 degree lid assembly that allows for a consumer to ingest a liquid along any location about a perimeter of the lid assembly.

BACKGROUND OF THE INVENTION

Travel containers for liquids are an extremely popular method for consumers to transport liquids. Due to their popularity, travel containers are constantly being innovated to improve functionality. These innovations have generally created either a spill-proof lid for a travel container, or an easily accessible spout engaged within a travel container. However, in each of these innovations arise an inherent issue, the spill-proof lids are usually cumbersome for a consumer to get to the liquid they would like to ingest and the easily accessible bottles often leak. However, lid assemblies often leak regardless of the focus of its construction, which is problematic for consumers. Another common issue regarding travel containers is the location of the spout which the consumer engages to then ingest the liquid. Travel containers are preventative regarding the habitual ease of ingesting a liquid whilst drinking from a standard cup and are generally inconvenient for the consumer due to the traditional, and singular, location of the spout within travel containers.

Therefore it is desirable to create a travel container with a lid assembly that is spill-proof as well as easily accessible through the provision of the capability for the consumer to ingest the liquid along any location about a perimeter of a rim of the lid assembly engaged with a travel container.

SUMMARY OF THE INVENTION

In concordance and agreement with the present invention, a new lid assembly has surprisingly been discovered.

The new lid assembly comprises a first component, a second component and a third component, the first component inclusive of a gear assembly within it, ultimately fastened by a button. The button is also engageable by a consumer to place the lid assembly in a closed position or to place the lid assembly in an open position whilst the gear assembly facilitates the transition from the open position to the closed position. The first component is centrally disposed within the second component, the first component spacingly distanced from the internal walls of the second component which allows for a liquid to travel through the lid assembly for the consumer to ingest the liquid. The third component is purposed to militate against liquid travelling through the lid assembly while the lid assembly is in the closed position as it correspondently operates through an initiation of a spring that is disposed between a fastener and a liquid filter of the second component, which the third component ultimately engages.

BRIEF DESCRIPTION OF THE DRAWINGS

The above-mentioned, and other features and objects of the invention, and the manner of attaining them will become more apparent and the invention itself will be better understood by reference to the following description of an embodiment of the invention taken in conjunction with the accompanying drawings, wherein.

DESCRIPTION OF THE PREFERRED EMBODIMENT

The following detailed description and appended drawings describe and illustrate various exemplary embodiments of the invention. The description and drawings serve to enable one skilled in the art to make, and use the invention, and are not intended to limit the scope of the invention in any manner. With respect to the methods disclosed, the steps presented are exemplary in nature, and thus, the order of the steps is not necessary or critical.

The present invention relates to lids, more specifically to lid assemblies such are used as a top-disposed component to be included within the full configuration of a container or travel container for liquids. However, the present disclosure can apply to other types of containers for liquids or in other applications. The lid assembly is designed to provide a consumer the capability to consume a liquid along any location about a perimeter of a rim of the lid assembly.

Figure 1:
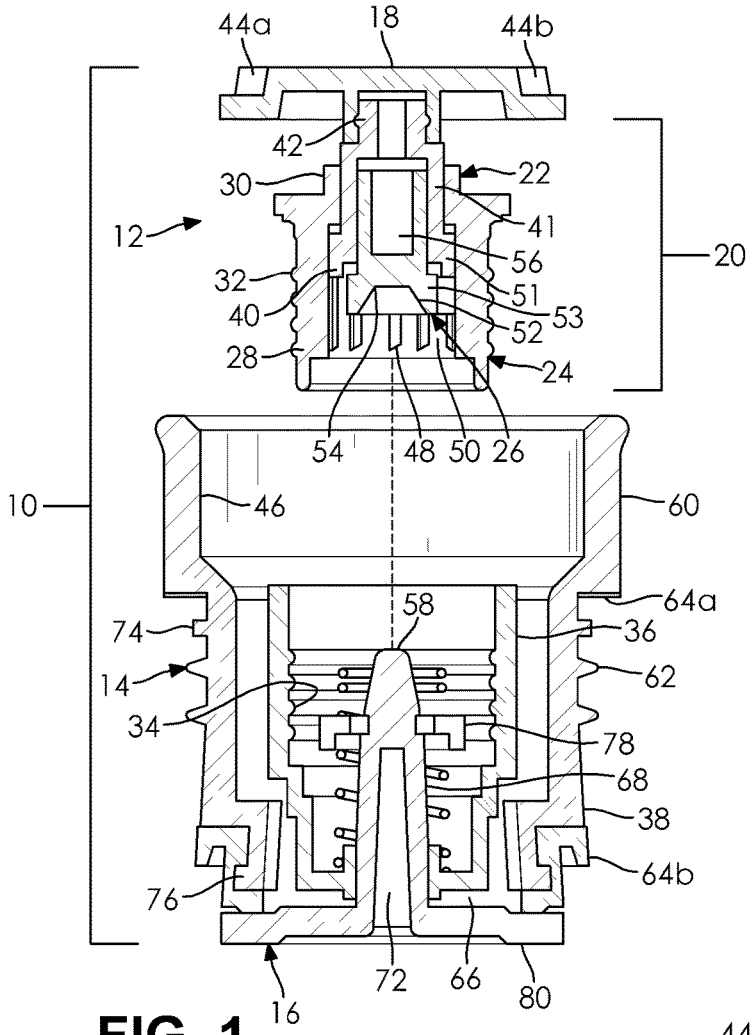
FIG. 1 is a partially exploded cross-sectional elevational view of a lid assembly according to the invention.
Figure 2:
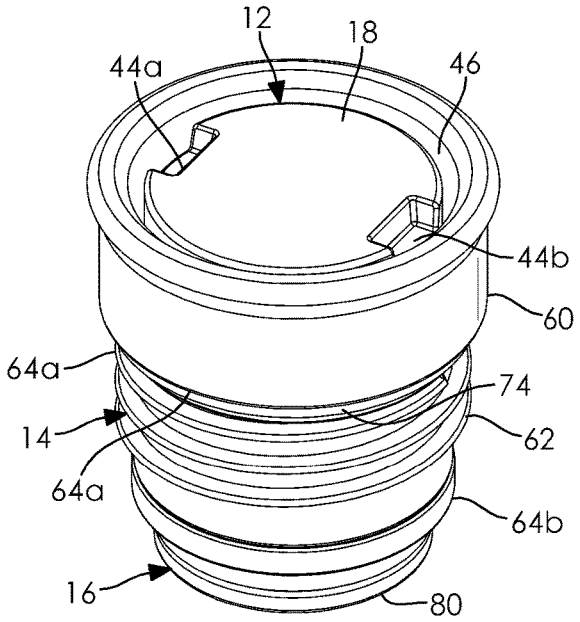
FIG. 2 is a top perspective view of the lid assembly according to FIG. 1, wherein the lid assembly is assembled.
Figure 3:
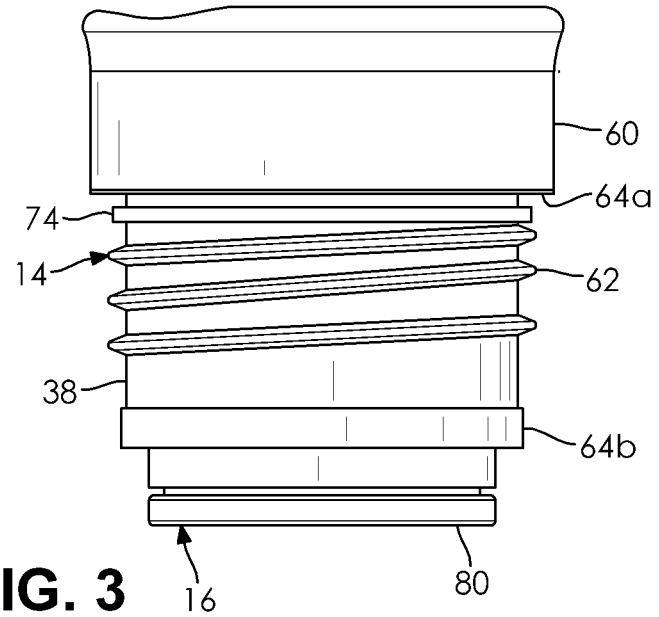
FIG. 3 is a side elevational view of the lid assembly according to FIG. 1.
Figure 4:
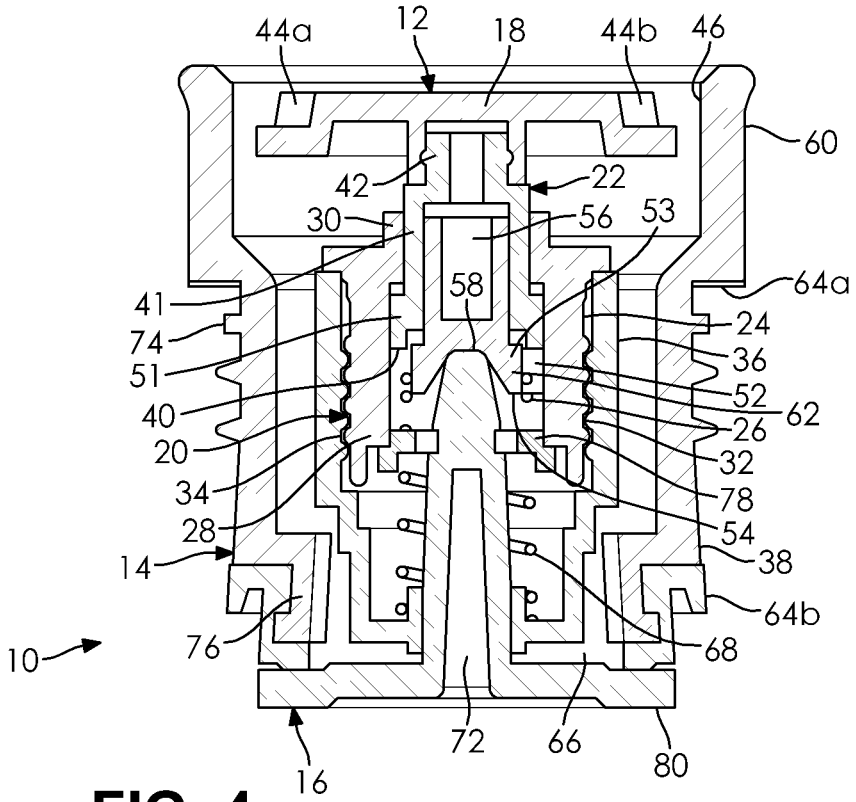
FIG. 4 is a cross-sectional elevational view of the lid assembly illustrating a closed position of the lid assembly according to FIG. 1.
Figure 5:
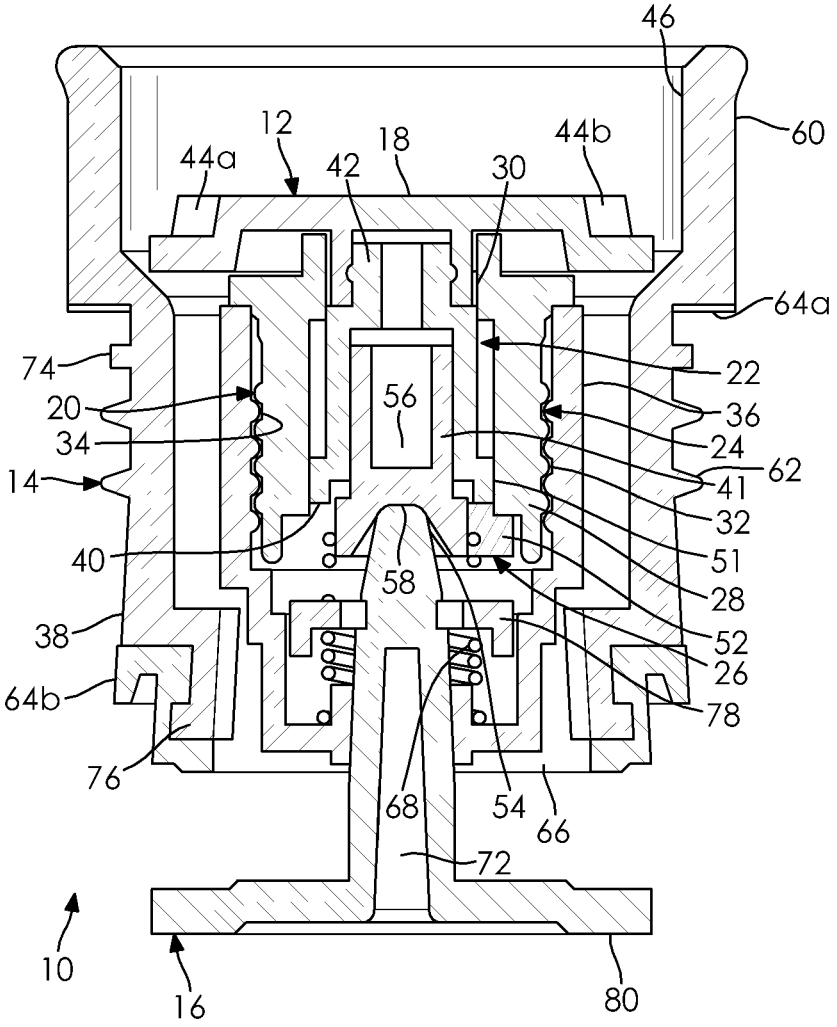
FIG. 5 is a cross-sectional elevational view of the lid assembly illustrating an open position of the lid assembly according to FIG. 1.

An embodiment of the present invention is illustrated within FIGS. 1-5 and is a lid assembly 10 generally composed of a first component 12, a second component 14 and a third component 16. However, it is understood that any number of components may be used to achieve a similarly intended result. Each of the first component 12, the second component 14 and the third component 16 are generally cylindrical. However, it is understood that any cross-sectional shape may be used.

The first component 12 is generally comprised of a button 18 and an internally based gear assembly 20. The gear assembly 20 is formed from a gear track 22, a drive gear 24 and a driven gear 26. However, it is understood that any number of gear formations may be used to achieve a similarly intended result.

The drive gear 24 is disposed over, and encapsulates, the gear track 22. The drive gear 24 has a first end 28 and a second end 30, the second end 30 having a smaller diameter than the diameter of the first end 28. The drive gear 24 also has an external threaded portion 32 that corresponds to an internal threaded portion 34 formed in a tube 36 disposed within a lid body 38 of the second component 14.

The gear track 22 has a first end 40, a median portion 41 and a second end 42, the first end 40 having a larger diameter than the median portion 41. The median portion 41 is disposed between the first end 40 and the button 18. The gear track 22 is contoured to form a smaller diameter of the second end 42, relative to the median portion 41, to engage the button 18, the button 18 abutts the median portion 41 directly. The median portion 41 is coupled to the first end 40 and is disposed beneath the abutting button 18. The outer diameter of the median portion 41 is smaller than the inner diameter of the second end 30 of the drive gear 24, which allows for the facilitation of a sliding motion. Stated differently, the median portion 41 is positioned within the drive gear 24 and is able to slidingly move in a lateral direction wherein complete disposition is militated against by both the button 18 and an instance of the first end 40 of the gear track 22 abutting the second end 30 of the drive gear 24, the first end 40 having a larger diameter than the second end 30.

The second end 42 of the gear track 22 of the gear assembly 20 is coupled to the button 18. The button 18 has a duality of indentations 44*a*, 44*b* disposed within the button 18 for engagement of a consumer's fingers or a tool to remove the button 18 and expose an interior of a lid body 46. The button 18 is removable by rotating the button 18 in a counter-clockwise rotational direction, whereby the threads of the external threaded portion 32 engage the threads of the internal threaded portion 34 moving the button 18 in an axial direction away from the lid body 38. Inherently, the button 18 may also be installed by rotating the button 18 in a clockwise rotational direction, whereby the threads of the external threaded portion 32 engage the threads of the internal threaded portion 34 moving the button 18 in an axial direction towards the lid body 38. The button 18 is maintained within a central axial position with respect to a longitudinal axis of the interior of the lid body 46.

While the drive gear 24 facilitates a vertical sliding motion between the gear track 22 and the drive gear 24, it also militates against a rotational motion between the gear track 22 and the drive gear 24. An annular array of grooves 48 and an annular array of spaces 50 is formed in the drive gear 24. The annular array of grooves 48 and the annular array of spaces 50 form a gear to engage an annular array of longitudinal protuberances 51 formed adjacent the first end 40 of the gear track 22. Further, the annular array of grooves 48 and the annular array of spaces 50 engage an annular array of teeth 53 of a gear-shaped base 52 of the driven gear 26.

Lastly, the driven gear 26 is a detachable piece that has the gear-shaped base 52, a recess 54 disposed within the gear-shaped base 52, and an extension 56 that is coupled to the gear-shaped base 52. The extension 56 has an outer diameter that is generally smaller than an inner diameter of the gear track 22 of the gear assembly 20. The gear-shaped base 52 engages directly with the first end 28 of the drive gear 24 maintaining its position within the gear assembly 20 while the extension 56 is disposed within the gear track 22. More specifically, the teeth of the gear-shaped base 52 engage directly with the annular array of grooves 48 and the annular array of spaces 50.

The recess 54 engages an abutment 58 which facilitates a rotational motion of the gear-shaped base 52. The gear-shaped base 52 of the driven gear 26 is caused to rotate upon depression of the button 18 to be selectively positioned within the annular array of spaces 50 in an open position of the lid assembly 10 according to FIG. 5 and is caused to rotate again upon depression of the button 18 to selectively position the teeth within the annular array of grooves 48 in a closed position of the lid assembly 10 according to FIG. 4. In other words, upon each depression of the button 18, the teeth of the gear-shaped base 52 rotate to be alternatively positioned within the annular array of grooves 48 and the annular array of spaces 50, respectively. That is, the lid assembly 10 alternates between the open position and the closed position upon each depression of the button 18.

The second component 14 is generally comprised of the lid body 38, a rim 60, an external threaded portion 62 to engage a liquid container (not shown), sealing rings 64*a*, 64*b*, a liquid filter 66, a spring 68 and the internally disposed tube 36 spaced radially inwardly from the interior of the lid body 38.

The liquid filter 66 is integrally molded to the lid body 38 and has a plurality of spaced apart openings (not shown). The plurality of spaced apart openings provide the capability for the liquid container affixed to the lid assembly 10 to accept solids in addition to liquid and provides confidence to the consumer that a majority of the included solids will not travel through the lid assembly 10 due to the functionality of the liquid filter 66. The liquid filter 66 also has a hole (not shown) centrally formed therein, to engage an extension 72 of the third component 16.

The lid body 38 is formed to accommodate the sealing rings 64*a*,64*b* which aid in the maintenance of providing a leak proof container. The sealing rings 64*a*,64*b* may be formed from a compressive water-proof material. A non-limiting example of such a material is silicon. More specifically, one of the sealing rings 64*a* is removably held in place by an external top-threaded portion 74 which militates against escape of liquid between the engagement of the lid assembly 10 to the container. The lid body 38 provides a contoured portion 76 proximate the liquid filter 66 to removably hold the other of the sealing rings 64*b* which extends around an end of the lid body 38 to abut the liquid filter 66, preventing the third component 16 from directly engaging the liquid filter 66. Rather, the other of the sealing rings 64*b* engages directly with the third component 16 forming a liquid-tight seal, which prevents liquid from traveling through the lid assembly 10.

The tube 36 is coupled to the liquid filter 66 which maintains its position within the interior of the lid body 46 allowing for a circumferentially even space between the tube 36 and the interior of the lid body 46. The liquid that passes through the liquid filter 66 also passes through the space between the tube 36 and the interior of the lid body 46. The liquid further travels through the space between the button 18 and the interior of the lid body 46 for the consumer to ingest. The corresponding engagement between the external threaded portion 32 and the internal threaded portion 34 maintains the position of the button 18 in relation to the interior of the lid body 46. The maintenance of the spacing between the button 18 and the interior of the lid body 46 facilitates the capability of the consumer to ingest the liquid along any location about the perimeter of the rim 60 of the lid assembly 10. The spring 68 is centrally disposed within the tube 36 and is covered by a lid 78. The spring 68 aids in the prevention of liquid entering through the liquid filter 66 while the lid assembly 10 is in the closed position; the elasticity of the spring 68 directly corresponds to the success of the liquid prevention as the elasticity of the spring 68 is also correspondent to the strength of the liquid-tight seal. The spring 68 urges the third component 16 in a direction of the second component 12.

The third component 16 is generally formed from the lid 78, a radially outwardly extending base 80 and the extension 72. The third component 16 and the first component 12 together form an internal component assembly with respect to the second component 14. The extension 72 is positioned through the hole (not shown) within the liquid filter 66, whereupon the spring 68 encircles the extension 72. The lid 78 is coupled to the abutment 58 which engages directly with the recess 54 of the first component 12 to support the rotational motion initiated by opening the lid assembly 10 and closing the lid assembly 10. The extension 72 has a smaller outer diameter than the inner diameter of the abutment 58, which allows for the extension 72 to be disposed within the abutment 58. The lid 78 also functions as a fastener, maintaining both the attachment between the third component 16 and the second component 14, as well as the central disposition within the tube 36.

A lid assembly as is shown and described herein provides numerous benefits over a traditional rendition of similarly designed lid assemblies without the provision the disclosed design provides, which is the consumer's capability of ingesting a liquid from the lid assembly from any angle along the lid assembly's rim in an open position of the lid assembly. The lid assembly also militates against undesirable leaking of the liquid in the lid assembly's closed position.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A lid assembly comprising:

an internal component assembly having a first end, a second end opposite the first end, and a button disposed at the first end, wherein the internal component includes an external threaded portion disposed adjacent the first end, wherein the internal component assembly includes a pair of components separate from each other, wherein a first one of the pair of components includes an annular array of radially outwardly extending teeth formed at an end of the first one of the pair of components, and a second one of the pair of components includes an annular array of grooves formed on an inner surface of the second one of the pair of components, an annular array of spaces each formed between adjacent ones of the annular array of grooves, and wherein the internal component includes an internally based gear assembly, and the internally based gear assembly includes a gear track, a drive gear having a first end and a second end adjacent the button, and a driven gear; and an external component having a top end and a bottom end, the external component receiving an entirety of the internal component assembly through the top end, the external component configured for engaging a container so the bottom end is received within the container, the internal component assembly cooperating with the external component to translate axially upon a first pressure to the button to permit a fluid to enter the external component adjacent the second end of the internal component assembly and to militate against the fluid to enter the external component adjacent the second end of the internal component upon a second pressure to the button, wherein the external component includes an internal threaded portion engaging the external threaded portion of the internal component, wherein the external component includes a lid body disposed adjacent the bottom end, a rim disposed adjacent the top end, and an internally disposed tube spaced radially inwardly from the interior of the body, wherein the fluid travels within a space created between the internally disposed tube and the lid body, wherein upon the first pressure to the button the annular array of radially outwardly extending teeth are positioned in the annular array of spaces and upon the second pressure to the button the annular array of radially outwardly extending teeth are positioned in the annular array of grooves, and wherein the button and the drive gear are separate components from each other, wherein the button is removeably coupled to the gear track through the top end of the external component, and wherein the button includes an indentation formed in an upper surface thereof to facilitate coupling of the button to the gear track.

2. The lid assembly of claim 1, wherein the second end of the internal component assembly extends at a distance away from the external component upon the first pressure to the button.

3. The lid assembly of claim 2, wherein the button translates axially inwardly with respect to the external component upon the first pressure to the button.

4. The lid assembly of claim 2, wherein the second end of the internal component assembly engages the external component upon the second pressure to the button.

5. The lid assembly of claim 4, wherein the button translates axially towards an outward direction with respect to the external component upon the second pressure to the button.

6. A lid assembly comprising:

an internal component assembly having a first end, a second end opposite the first end, and a button disposed at the first end and an internally based gear assembly, the internally based gear assembly includes a gear track, a drive gear having a first end and a second end adjacent the button, and a driven gear, the drive gear disposed over the gear track and the driven track, the driven gear disposed within the gear track, the second end of the drive gear has an outer diameter less than an outer diameter of the first end, the gear track directly coupled to the button and translates axially and simultaneously with a pressure applied to the button, wherein the internal component includes an external threaded portion disposed adjacent the first end; and an external component having a top end and a bottom end, the external component receiving an entirety of the internal component assembly through the top end, the external component configured for engaging a container so the bottom end is received within the container, the internal component assembly cooperating with the external component to translate axially upon a first pressure to the button to permit a fluid to enter the external component adjacent the second end of the internal component assembly and to militate against the fluid to enter the external component adjacent the second end of the internal component upon a second pressure to the button, wherein the external component includes an internal threaded portion engaging the external threaded portion of the internal component, wherein the external component includes a lid body disposed adjacent the bottom end, a rim disposed adjacent the top end, and an internally disposed tube spaced radially inwardly from the interior of the body, wherein the fluid travels within a space created between the internally disposed tube and the lid body, and wherein the button and the drive gear are separate components from each other, wherein the button is removeably coupled to the gear track through the top end of the external component, and wherein the button includes an indentation formed in an upper surface thereof to facilitate coupling of the button to the gear track.

* * * * *